US007030576B2

(12) United States Patent
McVey et al.

(10) Patent No.: US 7,030,576 B2
(45) Date of Patent: Apr. 18, 2006

(54) MULTICHANNEL HALL EFFECT THRUSTER

(75) Inventors: John B. McVey, Sunnyvale, CA (US); Andrew S. Perrucci, Los Gatos, CA (US); Edward J. Britt, Cupertino, CA (US)

(73) Assignee: United Technologies Corporation, Hartford, CT (US)

( * ) Notice: Subject to any disclaimer, the term of this patent is extended or adjusted under 35 U.S.C. 154(b) by 73 days.

(21) Appl. No.: 10/726,398

(22) Filed: Dec. 2, 2003

(65) Prior Publication Data

US 2005/0116652 A1 Jun. 2, 2005

(51) Int. Cl.
*H05H 7/00* (2006.01)

(52) U.S. Cl. ..... 315/501; 315/506; 315/111.61; 244/158.1; 250/423 R

(58) Field of Classification Search ..... 244/62, 244/71, 158 R, 166, 172, 158, 1, 171.1, 12.6; 60/202, 251; 315/501, 504, 506, 507, 111.21, 315/111.41, 111.61, 111.81, 111.91; 313/359.1, 313/362.1; 250/423 R, 423 F
See application file for complete search history.

(56) References Cited

U.S. PATENT DOCUMENTS 4,577,156 A * 3/1986 Kerst ..... 315/504
4,862,032 A * 8/1989 Kaufman et al. ..... 313/359.1
5,751,113 A 5/1998 Yashnov et al.
5,763,989 A * 6/1998 Kaufman ..... 313/361.1
5,845,880 A 12/1998 Petrosov et al.
5,847,493 A 12/1998 Yashnov et al.
6,158,209 A * 12/2000 Latischev et al. ..... 60/202
6,215,124 B1 * 4/2001 King ..... 250/423 R
6,279,314 B1 * 8/2001 Valentian et al. ..... 60/202

* cited by examiner

*Primary Examiner*—Haissa Philogene

(57) ABSTRACT

A Hall effect thruster for propelling spacecraft and satellites includes at least two acceleration channels, each of the channels has a closed end and an open end, and a plurality of flux guides adjacent each of the channels. The plurality of flux guides includes an innermost flux guide, an outermost flux guide, and at least one intermediate flux guide. Each intermediate flux guide helps provide a magnetic field to each of two adjacent acceleration channels.

18 Claims, 2 Drawing Sheets

MULTICHANNEL HALL EFFECT THRUSTER

BACKGROUND OF THE INVENTION

The present invention relates to a Hall effect thruster for use on satellites and other spacecraft. The Hall effect thruster of the present invention expands on previous design concepts by using multiple thruster or acceleration channels to obtain higher power density.

Hall effect thrusters usually consist of a magnetic system and a channel where xenon or some other gas propellant is ionized and accelerated to produce an exhaust beam. Common configurations might be a circular ring with an annular channel or a racetrack shape. An electromagnet system or possibly a permanent magnet system is located external to the channel and surrounds it. U.S. Pat. No. 5,751,113 to Yashnov et al; U.S. Pat. No. 5,847,493 to Yashnov et al.; and U.S. Pat. No. 5,845,880 to Petrosov et al. exemplify known Hall effect thruster designs.

For scaling to larger sizes and higher powers, it is necessary to increase both the length and the width of the channel to accommodate a larger active plasma region. This usually leads to designs with larger rings or other shapes, and with an empty space in the center region. The mass of a large thruster therefore is significantly increased, because it is necessary to make larger ferromagnetic material structures for flux guides to surround the larger rings. The empty region in the center is mostly wasted space. A larger annular thruster ring also leads to a wide cross-section for the exhaust plume.

It would be desirable to make use of the entire face area of a thruster and to create a smaller footprint with greater power density.

SUMMARY OF THE INVENTION

Accordingly, it is an object of the present invention to provide a Hall effect thruster which makes use of a larger portion of the face area of the thruster.

It is a further object of the present invention to provide a Hall effect thruster which creates a smaller footprint with greater power density.

The foregoing objects are attained by the Hall effect thruster of the present invention.

In accordance with the present invention, a Hall effect thruster is provided. The Hall effect thruster broadly comprises at least two acceleration channels, each of the channels having a closed end and an open end, and a plurality of flux guides adjacent each of the channels.

Other details of the multichannel Hall effect thruster of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
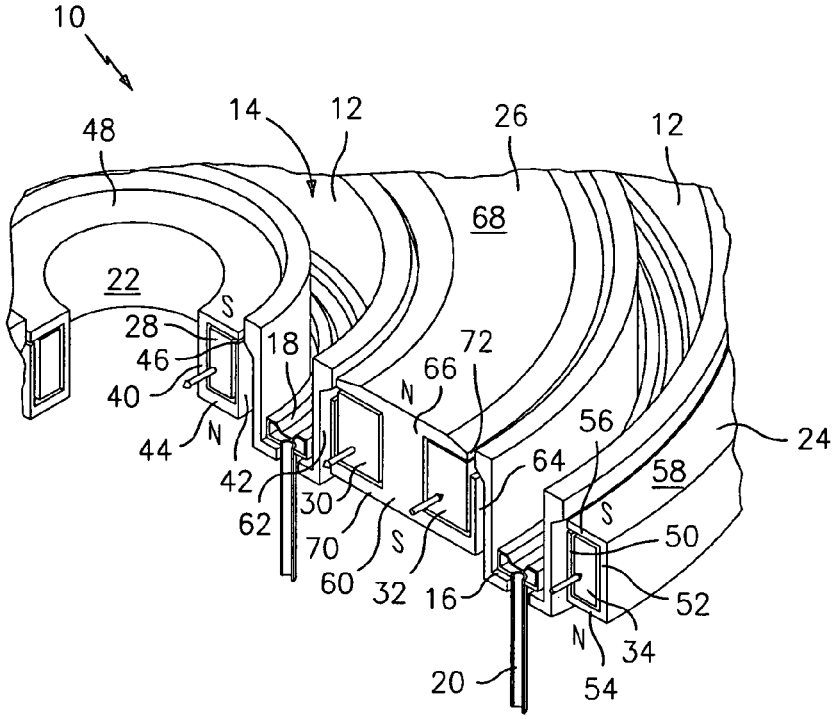
FIG. 1 is a partial sectional view of a multi-channel Hall effect thruster in accordance with the present invention.

Referring now to the drawings, a multi-channel Hall effect thruster 10 in accordance with the present invention is illustrated. As shown the thruster 10 has a plurality of acceleration channels 12. While two channels 12 have been illustrated, it is within the scope of the present invention for the thruster 10 to have more than two acceleration channels 12. Each of the channels 12 has an open end 14 and a closed end 16. Further, each channel 12 has a gas distribution anode 18 for distributing a propellant such as xenon, krypton, argon, or a mixture of propellant gases. A pipe 20 provides communication between a propellant source (not shown) and the anode 18. The anode 18 may be a shaped anode in the form of a hollow rectangular section tube having a groove extending continuously around it. An electrical connection (not shown) supplies positive potential to each anode 18.

In accordance with the present invention, each acceleration channel 12 may be composed of either a ceramic material (stationary plasma thruster) or at least one conducting material (anode layer thruster). Each acceleration channel 12 forms a closed loop having either an annular shape or a non-annular shape. For example, the two channels 12 shown in FIG. 1 may form concentric circles.

Figure 2:
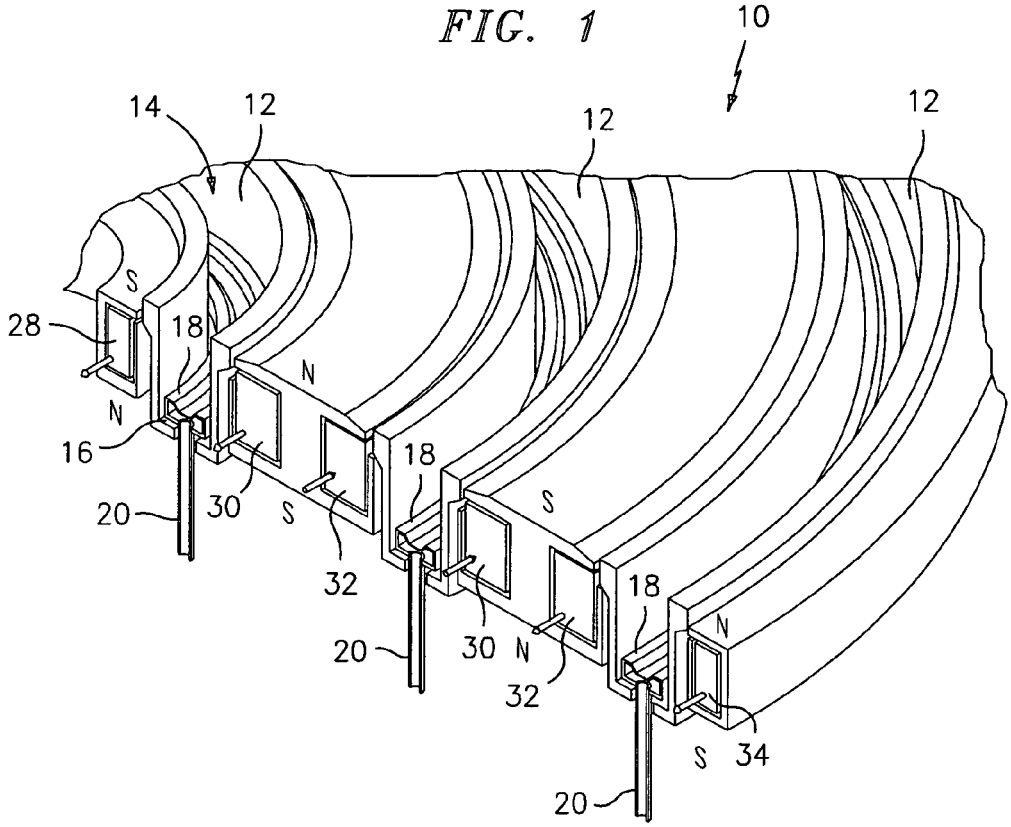
FIG. 2 illustrates an alternative embodiment of the multichannel Hall effect thruster of the present invention having a nested anode arrangement.

If desired, more than two nested acceleration channels 12 can be located inside of each other as shown in FIG. 2. The magnetic fields can be configured in such a way as to produce alternate directions for the helical motion of the thruster exhaust beams. Also, if desired, each channel 12 may have non-parallel surfaces.

The thruster 10 further has a number of ferromagnetic structures, each formed from a magnetically permeable material, which surround the channel(s) 12 and act as flux guides for the magnetic fields. The ferromagnetic structure 22 forms an innermost flux guide and the ferromagnetic structure 24 forms an outermost flux guide. The thruster 10 also has at least one intermediate ferromagnetic structure 26 which forms at least one intermediate flux guide positioned between adjacent ones of the channels 12. The ferromagnetic structure 26 may be such that it services both of the adjacent channels 12 to provide a magnetic field for each channel 12. Such an arrangement makes potential mass savings available.

The ferromagnetic structure 22 has an inner wall 40, an outer wall 42, and a lower connecting wall 44 which form an enclosure 46 for an electromagnetic coil or a permanent magnet 28. As can be seen from FIG. 1, the inner wall 40 is shorter than the outer wall 42. A flange 48 may be attached to the top of the wall 42.

The ferromagnetic structure 24 has an inner wall 50, an outer wall 52, and a lower connecting wall 54 which form an enclosure 56 for an electromagnetic coil or a permanent magnetic 34. As can be seen from FIG. 1, the inner wall 50 is shorter than the outer wall 52. A flange 58 may be attached to the top of the wall 52.

Each ferromagnetic structure 26 may have a U-shaped lower wall structure 60 with inner and outer legs 62 and 64 respectively, an intermediate wall 66 extending upwardly from the lower wall structure 60, and an upper wall structure 68. The intermediate wall 66, the upper wall structure 68 and the inner leg 62 form an enclosure 70 for an electromagnetic coil or a permanent magnet 30. The intermediate wall 66, the upper wall structure 68 and the outer leg 64 form an enclosure 72 for an electromagnetic coil or a permanent magnet 32.

As can be seen from the foregoing the ferromagnetic structures 22, 24 and 26 are each provided with electromagnetic coils or permanent magnets 28, 30, 32, and 34 which act as a source of an appropriate magnetic field.

Figure 3:
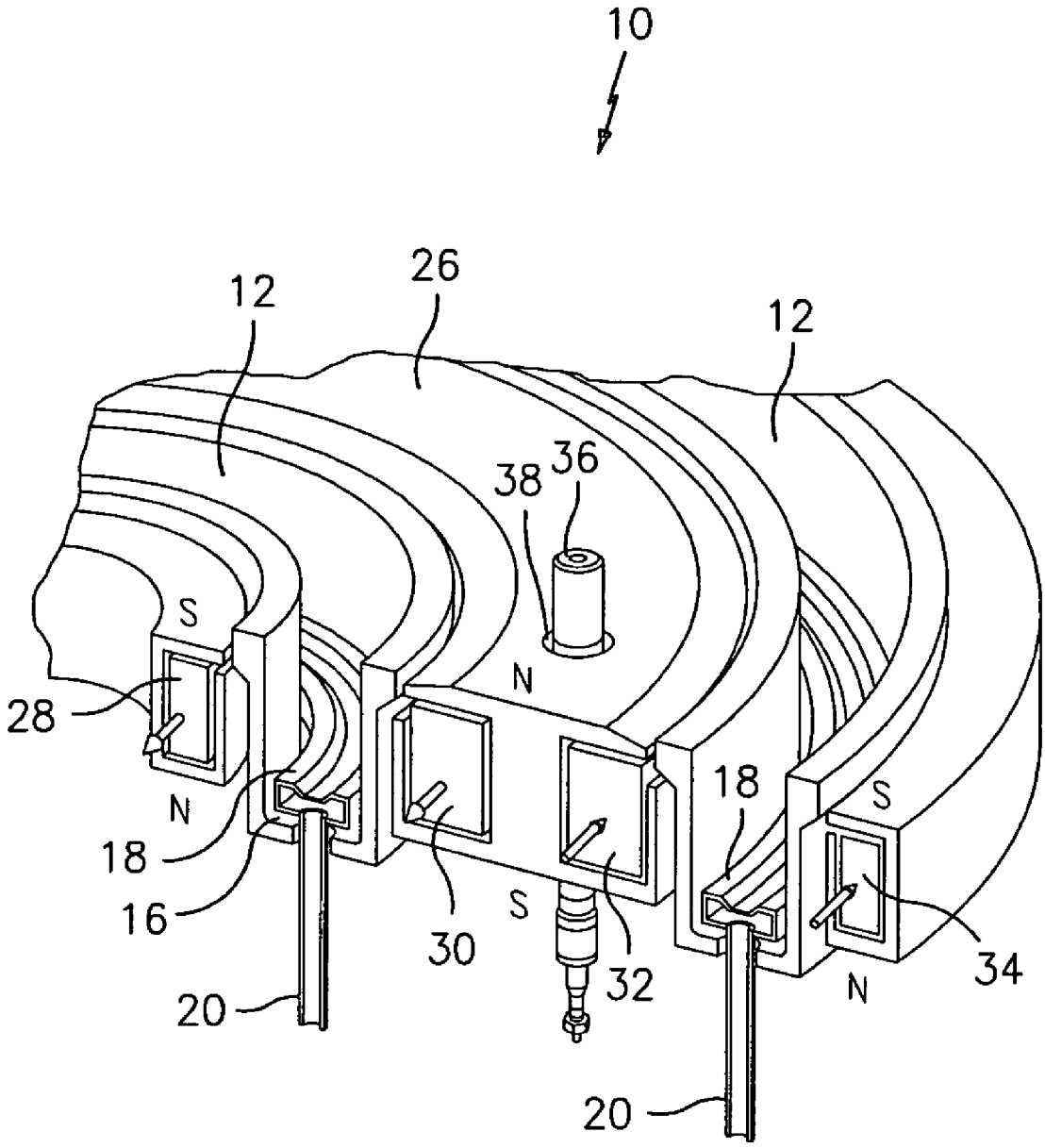
FIG. 3 illustrates a possible cathode arrangement for use in the multi-channel Hall effect thruster of the present invention.

The thruster 10 also has at least one cathode 36 for neutralization of the beam current. The cathode(s) 36 if desired may be located in holes 38 in the ferromagnetic structure 26 as shown in FIG. 3. Each cathode 36 may be supplied with a source of negative potential via an electrical connector (not shown).

A Hall effect thruster is an electrostatic ion accelerator. A radial magnetic field is generated across each thrust or acceleration channel 12 that inhibits electron transport from an external cathode 36 to an anode 18 placed at the bottom of each channel 12. This field interacts with the electrons to create an azimuthal Hall current at each thrust channel exit 14. A negative charged region of the plasma is produced by the concentration of electrons localized at the channel exit by the magnetic field. Xenon gas or other ionizable propellant is fed into each channel 12 through passages in each anode 18. Positive ions are created near each anode 18 by collisions between propellant atoms and electrons. There is an axial electric field between the region of ionization down inside the channel and electrons at exit, which accelerates these ions, creating propulsion.

The thruster 10 of the present invention eliminates a potential problem with high power thrusters. Because there is a small rotational component to the thruster exhaust plume, there is a small torque applied to a spacecraft in reaction to this helical motion of the exhaust. By arranging the electromagnetic coils or magnets 28, 30, 32 and 34 in such a way as to produce counter-rotating exhaust plumes from adjacent channels 12, the torque can be cancelled out.

By using more of the space inside of a thruster ring, a more compact engine can be produced. The shared ferromagnetic material in the magnetic flux guides has the potential for mass savings, and reduced power in electromagnetic coils. It is not necessary to operate all the channels at the same discharge voltage. Different potentials could be applied to each of the anodes 18 to produce a more optimized thruster performance. The magnetic field shapes for different channels 12 may be arranged differently in order to optimize the profile of the exhaust plume.

If desired, different propellant gases can be used in different ones of the channels 12 for different operating conditions or optimizing specific impulse.

It is apparent that there has been provided in accordance with the present invention a multichannel Hall effect thruster which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A Hall effect thruster comprising:

at least two acceleration channels;

each of said channels having a closed end and an open end; and a plurality of flux guides adjacent each of said channels, said plurality of flux channels including an innermost flux guide, an outermost flux guide, and at least one intermediate flux guide.

2. A Hall effect thruster according to claim 1, further comprising each of said acceleration channels having an annular configuration.

3. A Hall effect thruster according to claim 1, further comprising each of said acceleration channels having a non-annular configuration.

4. A Hall effect thruster according to claim 1, wherein each of said flux guides has a permanent magnet.

5. A Hall effect thruster according to claim 1, wherein each said intermediate flux guide assists in providing a magnetic field to each of said two adjacent acceleration channels.

6. A Hall effect thruster according to claim 1, wherein each of said flux guides has an electromagnetic coil.

7. A Hall effect thruster having a compact design comprising:

at least two acceleration channels with a first one of said channels surrounding a second one of said channels;

each of said channels having a closed end and an open end; and a plurality of flux guides adjacent each of said channels.

8. A Hall effect thruster according to claim 7, wherein each of said acceleration channels has a gas distribution anode for introducing a propellant.

9. A Hall effect thruster according to claim 8, wherein said gas distribution channel in a first one of said acceleration channels introduces a first propellant and a gas distribution anode in a second one of said acceleration channels introduces a second propellant, which second propellant is different from said first propellant.

10. A Hall effect thruster according to claim 7, wherein each of said channels is non-annular.

11. A Hall effect thruster according to claim 7, further comprising at least one cathode for neutralizing current.

12. A Hall effect thruster according to claim 11, further comprising said plurality of flux guide including at least one intermediate flux guide located intermediate two adjacent ones of said acceleration channels and each said cathode being located in a hole in said intermediate magnetic flux guide.

13. A Hall effect thruster according to claim 7, wherein adjacent ones of said acceleration channels generate counter-rotating exhaust plumes.

14. A Hall effect thruster according to claim 7, wherein each said channel has non-parallel surfaces.

15. A Hall effect thruster according to claim 7, wherein each of said channels is annular.

16. A Hall effect thruster according to claim 7, wherein said channels are concentric.

17. A Hall effect thruster according to claim 7, wherein said channels are nested.

18. A Hall effect thruster comprising:

at least two acceleration channels;

each of said channels having a closed end and an open end;

a plurality of flux guides adjacent each of said channels; and wherein a first one of said acceleration channels has a discharge voltage different from a discharge voltage of a second one of said acceleration channels.

* * * * *